US009032923B2

(12) United States Patent
Yoshika et al.

(10) Patent No.: US 9,032,923 B2
(45) Date of Patent: May 19, 2015

(54) INTERNAL COMBUSTION ENGINE WITH VARIABLE VALVE DEVICE

(75) Inventors: Daisuke Yoshika, Okazaki (JP); Ayatoshi Matsunaga, Okazaki (JP)

(73) Assignee: MITSUBISHI JIDOSHA KOGYO KABUSHIKI KAISHA, Tokyo (JP)

( * ) Notice: Subject to any disclaimer, the term of this patent is extended or adjusted under 35 U.S.C. 154(b) by 65 days.

(21) Appl. No.: 13/016,578

(22) Filed: Jan. 28, 2011

(65) Prior Publication Data

US 2011/0197839 A1 Aug. 18, 2011

(30) Foreign Application Priority Data

Feb. 12, 2010 (JP) ..... 2010-029021

(51) Int. Cl.

| | |
|---|---|
| ***F01L 1/34*** | (2006.01) |
| ***F01L 1/047*** | (2006.01) |
| ***F01L 1/344*** | (2006.01) |

(52) U.S. Cl.

CPC . *F01L 1/047* (2013.01); *F01L 1/34* (2013.01); *F01L 1/3442* (2013.01); *F01L 2001/0473* (2013.01); *F01L 2001/34489* (2013.01); *F01L 2001/34496* (2013.01); *F01L 2820/041* (2013.01)

(58) Field of Classification Search

USPC ..... 123/90.15, 90.17; 464/160

See application file for complete search history.

(56) References Cited

U.S. PATENT DOCUMENTS

| | | | | |
|---|---|---|---|---|
| 7,198,012 | B2 * | 4/2007 | Suga et al. | 123/90.17 |
| 7,210,440 | B2 * | 5/2007 | Lawrence et al. | 123/90.6 |
| 7,681,541 | B2 * | 3/2010 | Boggess et al. | 123/90.17 |
| 7,958,859 | B2 * | 6/2011 | Methley et al. | 123/90.6 |
| 8,215,274 | B2 * | 7/2012 | Rozario et al. | 123/90.17 |
| 2005/0166877 | A1 | 8/2005 | Suga et al. | |
| 2009/0276145 | A1 | 11/2009 | Schafer et al. | |
| 2009/0308338 | A1 | 12/2009 | Tashiro | |
| 2009/0314235 | A1 | 12/2009 | Rozario et al. | |

FOREIGN PATENT DOCUMENTS

| | | | | |
|---|---|---|---|---|
| EP | 1696107 | A1 | | 8/2006 |
| GB | 2424256 | A | | 9/2006 |
| GB | 2467333 | A | | 8/2010 |
| GB | 2472054 | A | | 1/2011 |
| JP | 2001-123806 | A | | 5/2001 |
| JP | 2002-054410 | A | | 2/2002 |
| JP | 2005-214141 | A | | 8/2005 |
| JP | 2008-002324 | A | | 1/2008 |
| JP | 2009-144521 | A | | 7/2009 |
| JP | 2009144521 | A | * | 7/2009 |

* cited by examiner

*Primary Examiner* — Thomas Denion
*Assistant Examiner* — Daniel Bernstein
(74) *Attorney, Agent, or Firm* — Birch, Stewart, Kolasch & Birch, LLP

(57) ABSTRACT

An engine with a variable valve device includes cylinders each provided with a plurality of intake valves, an outer camshaft for driving first intake cams, an inner camshaft arranged coaxially with the outer camshaft for driving second intake cams, and a cam phase change mechanism arranged at one end of the outer and inner camshafts and capable of varying the phase difference between the two camshafts. A first cam sensor for detecting the rotational angle of the outer camshaft and a second cam sensor for detecting the rotational angle of the inner camshaft are arranged close to the one end of the camshafts.

16 Claims, 4 Drawing Sheets

INTERNAL COMBUSTION ENGINE WITH VARIABLE VALVE DEVICE

BACKGROUND OF THE INVENTION

1. Field of the Invention

The present invention relates to an internal combustion engine equipped with a cam phase change mechanism capable of varying phases of intake or exhaust cams.

2. Description of the Related Art

Recently, more and more internal combustion engines have come to be equipped with cam phase change mechanisms as a variable valve device for varying the opening/closing timings of intake or exhaust valves. Also, techniques have been developed in which two cam phase change mechanisms are applied to an internal combustion engine having each cylinder provided with a plurality of valves so that the valve opening/closing timings of all valves as well as of only some of the valves can be varied in accordance with the operating condition of the engine.

A valve device employed in this type of engine uses a camshaft with a double shaft structure comprising an inner camshaft and an outer camshaft. The camshaft has such a construction that, out of the multiple valves, some can be opened and closed by the inner camshaft while the others can be opened and closed by the outer camshaft. For each of the cam phase change mechanisms, a vane-type hydraulic actuator is used, for example. The cam phase change mechanisms are attached to the respective opposite ends of the camshaft and configured such that one of the cam phase change mechanisms is capable of collectively varying the rotational angles of both the inner and outer camshafts while the other cam phase change mechanism is capable of varying the rotational angle difference, or what is called a split, between the inner and outer camshafts (Japanese Laid-open Patent Publication No. 2009-144521).

In the engine disclosed in the patent publication, the operation of each of the two cam phase change mechanisms is controlled in accordance with the operating condition of the engine, to variably control the valve opening/closing timings. Also, in order to accurately control the valve opening/closing timings, cam sensors for detecting the actual rotational angles of the inner and outer camshafts, respectively, are generally provided so that the detected rotational angles may be used for the operation control of the cam phase change mechanisms.

The camshaft, however, undergoes torsion because the camshaft is driven by torque transmitted to a sprocket attached to one end thereof. Such torsion fluctuates with fluctuation of the torque and possibly becomes significantly large in cases where heavy objects like the cam phase change mechanisms are attached to the opposite ends of the camshaft, as in the engine disclosed in the above patent publication. Accordingly, even though the actual rotational angle of the camshaft is detected by the cam sensor, the detected rotational angle may possibly contain substantial error due to the torsion or torsional vibration of the camshaft.

Especially in the case of the aforementioned variable valve device equipped with two cam phase change mechanisms, the detection error is significantly large because error is introduced into the detected rotational angle at two points due to the torsion or torsional vibration of the camshaft, possibly making accurate control of the split difficult.

SUMMARY OF THE INVENTION

An object of the present invention is to provide an internal combustion engine with a variable valve device which includes a camshaft with a double shaft structure capable of varying the phase of only some of a plurality of valves and which enables accurate detection of a rotational angle difference, between the two camshafts.

To achieve the object, the present invention provides an internal combustion engine with a variable valve device, the engine including cylinders each provided with a plurality of intake or exhaust valves, a first camshaft and a second camshaft arranged coaxially with each other, the first camshaft being configured to drive cams for actuating some of the valves and the second camshaft being configured to drive cams for actuating others of the valves, and a cam phase change mechanism arranged at one end of the first and second camshafts and capable of varying a phase difference between the first and second camshafts, wherein the engine further comprises first detection unit that detects a rotational angle of the first camshaft, and second detection unit that detects a rotational angle of the second camshaft, and the first and second detection unit are arranged on an identical side of the engine with respect to an axial direction of the first and second camshafts.

Thus, an actual phase difference between the first and second camshafts can be obtained from the difference between the rotational angles of the two camshafts respectively detected by the first and second detection unit. Since the first and second detection unit are positioned close to each other in the axial direction of the camshafts, the difference between errors contained in the detection values of the first and second detection unit due to torsion or torsional vibration of the camshafts can be lessened. As a result, the operation control of the engine can be stabilized, making it possible to improve the fuel efficiency and suppress vibration.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE INVENTION

Embodiments of the present invention will be hereinafter described with reference to the accompanying drawings.

Figure 1:
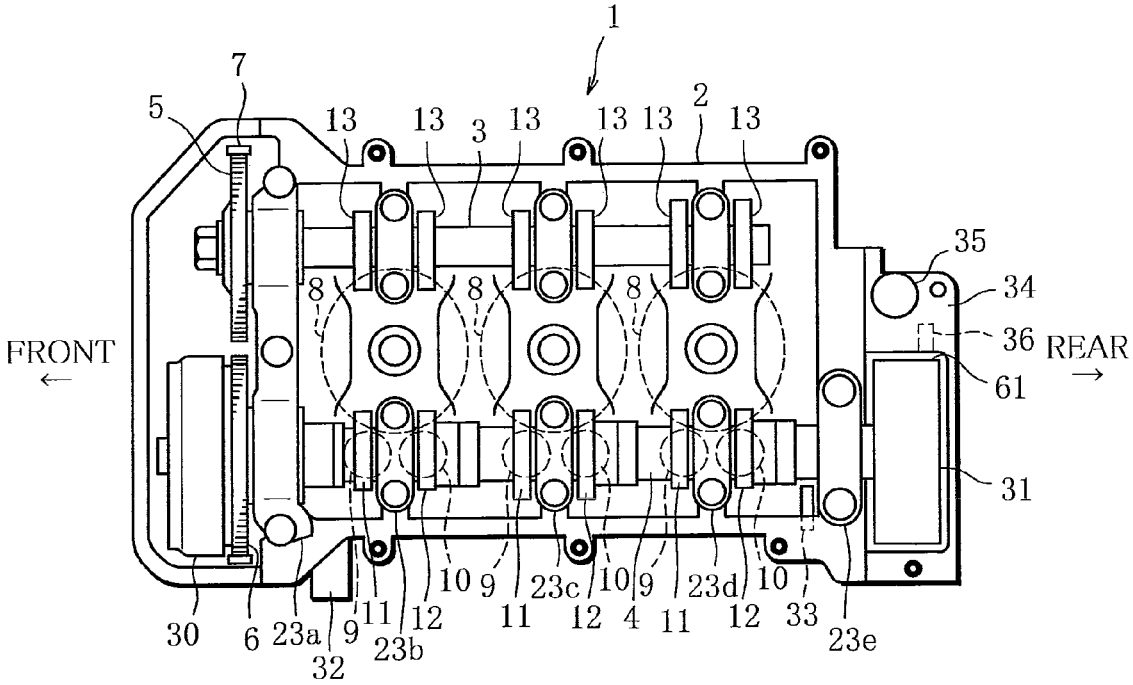
FIG. 1 is a top view illustrating the construction inside a cylinder head of an internal combustion engine according to the present invention.
Figure 2:
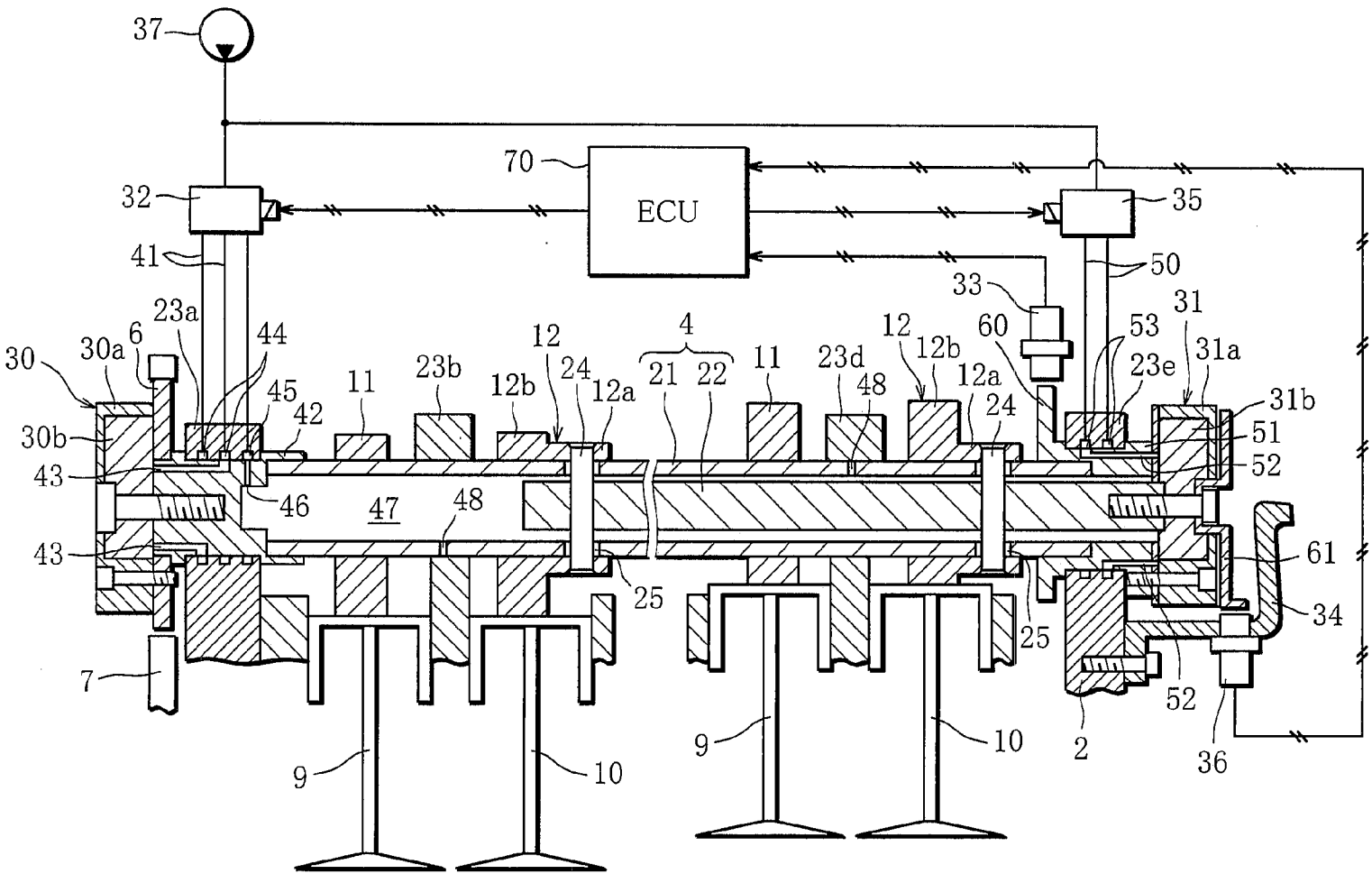
FIG. 2 is a longitudinal sectional view illustrating the structure of a valve device according to a first embodiment of the present invention.

FIG. 1 is a top view illustrating the construction inside a cylinder head 2 of an internal combustion engine (hereinafter merely referred to as engine 1) with a variable valve device according to the present invention. FIG. 2 is a sectional view illustrating the structure of an intake camshaft 4 and a supporting section therefor.

The engine 1 used in the embodiments of the invention is an in-line three-cylinder engine with a DOHC valve train. As illustrated in FIG. 1, cam sprockets 5 and 6 are connected to exhaust and intake camshafts 3 and 4, respectively, rotatably supported inside the cylinder head 2, and are also coupled to a crankshaft, not shown, by a chain 7.

Each cylinder 8 of the engine 1 is provided with two intake valves 9 and 10 and two exhaust valves, not shown. The two intake valves 9 and 10 are actuated by first and second intake cams 11 and 12, respectively, which are alternately arranged on the intake camshaft 4. Specifically, out of the two intake valves, the first intake valve 9 is actuated by the first intake cam 11, and the second intake valve 10 is actuated by the second intake cam 12. The two exhaust valves, on the other hand, are actuated by respective exhaust cams 13 fixed on the exhaust camshaft 3.

As illustrated in FIG. 2, the intake camshaft 4 has a double shaft structure comprising a hollow outer camshaft 21 and an inner camshaft 22 inserted through the outer camshaft 21. The outer and inner camshafts 21 and 22 are coaxially arranged with some gap therebetween and are rotatably supported by a plurality of bearings 23*a* to 23*e* formed on the cylinder head 2 of the engine 1.

The first intake cams 11 are fixed on the outer camshaft 21, while the second intake cams 12 are rotatably supported on the outer camshaft 21. Each second intake cam 12 includes a cylindrical supporting section 12*a* through which the outer camshaft 21 is inserted, and a cam lobe 12*b* protruding from the outer periphery of the supporting section 12*a* and configured to actuate the corresponding second intake valve 10. The second intake cam 12 is fixed to the inner camshaft 22 by a fixing pin 24. The fixing pin 24 penetrates through the supporting section 12*a* of the second intake cam 12 as well as through the outer and inner camshafts 21 and 22 and is securely fixed in a hole cut through the inner camshaft 22 with substantially no gap left between the fixing pin 24 and the inner camshaft 22. The outer camshaft 21 has a circumferentially elongated hole 25 formed therein to allow the fixing pin 24 to pass therethrough. Consequently, the first intake cams 11 are driven by rotation of the outer camshaft 21, while the second intake cams 12 are driven by rotation of the inner camshaft 22.

A first cam phase change mechanism 30 and a second cam phase change mechanism 31 are arranged at respective opposite ends of the intake camshaft 4. For each of the first and second cam phase change mechanisms 30 and 31, a vane-type hydraulic actuator conventionally known in the art is used, for example. The vane-type hydraulic actuator includes a cylindrical housing and a vane rotor rotatably arranged in the housing, and has the function of varying the rotational angle of the vane relative to the housing in accordance with the amount of operating oil supplied to the interior of the housing.

The first cam phase change mechanism 30 is attached to the front end of the intake camshaft 4. Specifically, the first cam phase change mechanism 30 has a housing 30*a* fixed to the cam sprocket 6 and has a vane rotor 30*b* fixed to the outer camshaft 21.

The second cam phase change mechanism 31 is attached to the rear end of the intake camshaft 4. Specifically, the second cam phase change mechanism 31 has a housing 31*a* fixed to the outer camshaft 21 and has a vane rotor 31*b* fixed to the inner camshaft 22.

Accordingly, the first cam phase change mechanism 30 is capable of varying the rotational angle of the outer camshaft 21 relative to the cam sprocket 6, while the second cam phase change mechanism 31 is capable of varying the rotational angle of the inner camshaft 22 relative to the outer camshaft 21. Namely, the first cam phase change mechanism 30 has the function of collectively varying the valve opening/closing timings of the first and second intake valves 9 and 10 as a whole with respect to the valve opening/closing timing of the exhaust valves, and the second cam phase change mechanism 31 has a split change function, that is, the function of varying a difference between the valve opening/closing timings of the first and second intake valves 9 and 10.

To the cylinder head 2 are fixed a first oil control valve 32 for controlling the supply/discharge of the operating oil to/from the first cam phase change mechanism 30, and a first cam sensor 33 for detecting an actual rotational angle of the outer camshaft 21. A cover 34 for covering a lower half of the second cam phase change mechanism 31 is secured to the rear part of the cylinder head 2. A second oil control valve 35 for controlling the supply/discharge of the operating oil to/from the second cam phase change mechanism 31 and a second cam sensor 36 for detecting the rotational angle of the vane rotor 31*b* of the second cam phase change mechanism 31 are fixed to the cover 34.

The first and second oil control valves 32 and 35 are supplied with the operating oil from an oil pump 37 securely mounted to the cylinder block of the engine 1.

The operating oil is supplied from the first oil control valve 32 to the first cam phase change mechanism 30 via oil passages 41 formed through the cylinder head 2 and oil passages 43 formed through a cam journal 42. The cam journal 42 forms a front end portion of the outer camshaft 21 supported by the bearing 23*a* and is cylindrical in shape. Annular oil grooves 44 are formed in the inner peripheral surface of the bearing 23*a*, and the oil passages 43 open in the outer peripheral surface of the cam journal 42 so as to face the oil grooves 44. Thus, the bearing 23*a* and the cam journal 42, which rotate relative to each other, are configured such that the oil passages 41 and 43 always communicate with each other. The drain of the first oil control valve 32 is connected via an oil groove 45 formed in the inner peripheral surface of the bearing 23*a* and an oil passage 46 formed through the cam journal 42 to a space 47 between the outer and inner camshafts 21 and 22. The operating oil discharged into the space 47 is supplied as lubricating oil to sliding portions of the bearings 23*b* to 23*d* and the inner peripheral surfaces of the second cams 12 through oil passages 48 and the elongate holes 25.

Also, the operating oil is supplied from the second oil control valve 35 to the second cam phase change mechanism 31 via oil passages 50 formed through the cylinder head 2 and oil passages 52 formed through a cam journal 51. The cam journal 51 forms a rear end portion of the outer camshaft 21 supported by the bearing 23*e* and has a cylindrical shape. Annular oil grooves 53 are formed in the inner peripheral surface of the bearing 23*e*, and the oil passages 52 open in the outer peripheral surface of the cam journal 51 so as to face the oil grooves 53. Thus, the bearing 23*e* and the cam journal 51, which rotate relative to each other, are configured such that the oil passages 50 and 52 always communicate with each other.

The first cam sensor 33 is positioned such that a sensor target 60 formed on the cam journal 51 passes in front of a detection surface of the first cam sensor 33. By detecting the timing at which the sensor target 60 passes by the first cam sensor 33 as the outer camshaft 21 rotates, the first cam sensor 33 detects the actual rotational angle of the outer camshaft 21. The sensor target 60 is formed by extending part of the front end portion of the cam journal 51 in a radially outward direction and is located close to the bearing 23*e* in the axial direction.

The second cam sensor 36 is positioned such that a sensor target 61 fixed to the vane rotor 31*b* of the second cam phase change mechanism 31 passes in front of a detection surface of the second cam sensor 36. By detecting the timing at which the sensor target 61 passes by the second cam sensor 36 as the inner camshaft 22 rotates, the second cam sensor 36 detects the actual rotational angle of the inner camshaft 22. The sensor target 61 is a disk-shaped member covering the rear surface of the second cam phase change mechanism 31 and is configured such that a part protruding from an outer edge thereof is capable of facing the detection surface of the second cam sensor 36.

An ECU 70 is input with information about the operating condition (torque, rotating speed, and so forth) of the engine 1 as well as with the detection values from the first and second cam sensors 33 and 36, and controls the first and second oil control valves 32 and 35. Specifically, in accordance with the operating condition of the engine 1, the ECU 70 calculates a target value for the rotational angle of the outer camshaft 21, which corresponds to the overall phase of the first and second intake valves 9 and 10, and also calculates a target value for the rotational angle difference between the outer and inner camshafts 21 and 22, which corresponds to the phase difference between the valve opening/closing timings of the first and second intake valves 9 and 10. Further, the ECU 70 calculates a difference between the actual rotational angle of the outer camshaft 21, which is input from the first cam sensor 33, and the actual rotational angle of the inner camshaft 22, which is input from the second cam sensor 36, to obtain an actual rotational angle difference between the outer and inner camshafts 21 and 22. The ECU 70 then controls the first oil control valve 32 to control the operation of the first cam phase change mechanism 30 so that the actual rotational angle of the outer camshaft 21, indicated by the first cam sensor 33, may become equal to its corresponding target value, and also controls the second oil control valve 35 to control the operation of the second cam phase change mechanism 31 so that the actual rotational angle difference between the outer and inner camshafts 21 and 22 may become equal to its corresponding target value.

Namely, the overall phase of the first and second intake valves 9 and 10 is variably controlled by the first cam phase change mechanism 30, and the actual phase is ascertained by the rotational angle of the outer camshaft 21 detected by the first cam sensor 33. Likewise, the phase difference between the valve opening/closing timings of the first and second intake valves 9 and 10 is variably controlled by the second cam phase change mechanism 31, and the actual phase difference is ascertained by the difference between the rotational angles of the outer and inner camshafts 21 and 22 detected by the first and second cam sensors 33 and 36, respectively.

Particularly, in this embodiment, the sensor target 60 is provided on the cam journal 51 located at the rear end of the outer camshaft 21, to permit the rotational angle of the outer camshaft 21 to be detected at a location more rearward than any of the first and second intake cams 11 and 12. On the other hand, the second cam sensor 36 is positioned close to the second cam phase change mechanism 31 which is located at the rear end of the outer camshaft 21. Thus, the first and second cam sensors 33 and 36 are both located more rearward than any of the first and second intake cams 11 and 12 such that the cam sensors 33 and 36 are located in the vicinity of the second cam phase change mechanism 31 and also are close to each other in the axial direction of the intake camshaft 4.

In this manner, the first and second cam sensors 33 and 36 are positioned close to each other in the axial direction of the intake camshaft 4. Accordingly, even if the intake camshaft 4 undergoes torsion because of the torque input thereto, the amount of torsion between the detection position of the first cam sensor 33 and that of the second cam sensor 36 can be suppressed to a small value. It is therefore possible to restrain error from being introduced due to such torsion into the rotational angle difference between the outer and inner camshafts 21 and 22 calculated from the detection values of the first and second cam sensors 33 and 36, thus enabling accurate control of the second cam phase change mechanism 31.

According to this embodiment, the engine cylinders 8 are each provided with the multiple intake valves 9 and 10, and the phase difference between the valves, namely, the split between some valves (first intake valves 9) and the other valves (second intake valves 10) is variably controlled by the second cam phase change mechanism 31. Since the second cam phase change mechanism 31 can be accurately controlled as stated above, various performances of the engine 1, such as the exhaust performance, engine output and fuel efficiency, can be effectively improved. For example, by controlling the second cam phase change mechanism 31 so as to increase the phase difference during a low-speed, low-load operation, it is possible to lower the pumping loss without fail during the low-speed, low-load operation, so that the fuel efficiency and the exhaust performance can be reliably improved.

In the foregoing embodiment, the present invention is applied to the intake camshaft 4. It should be noted that the invention is also equally applicable to the exhaust camshaft 4.

Figure 3:
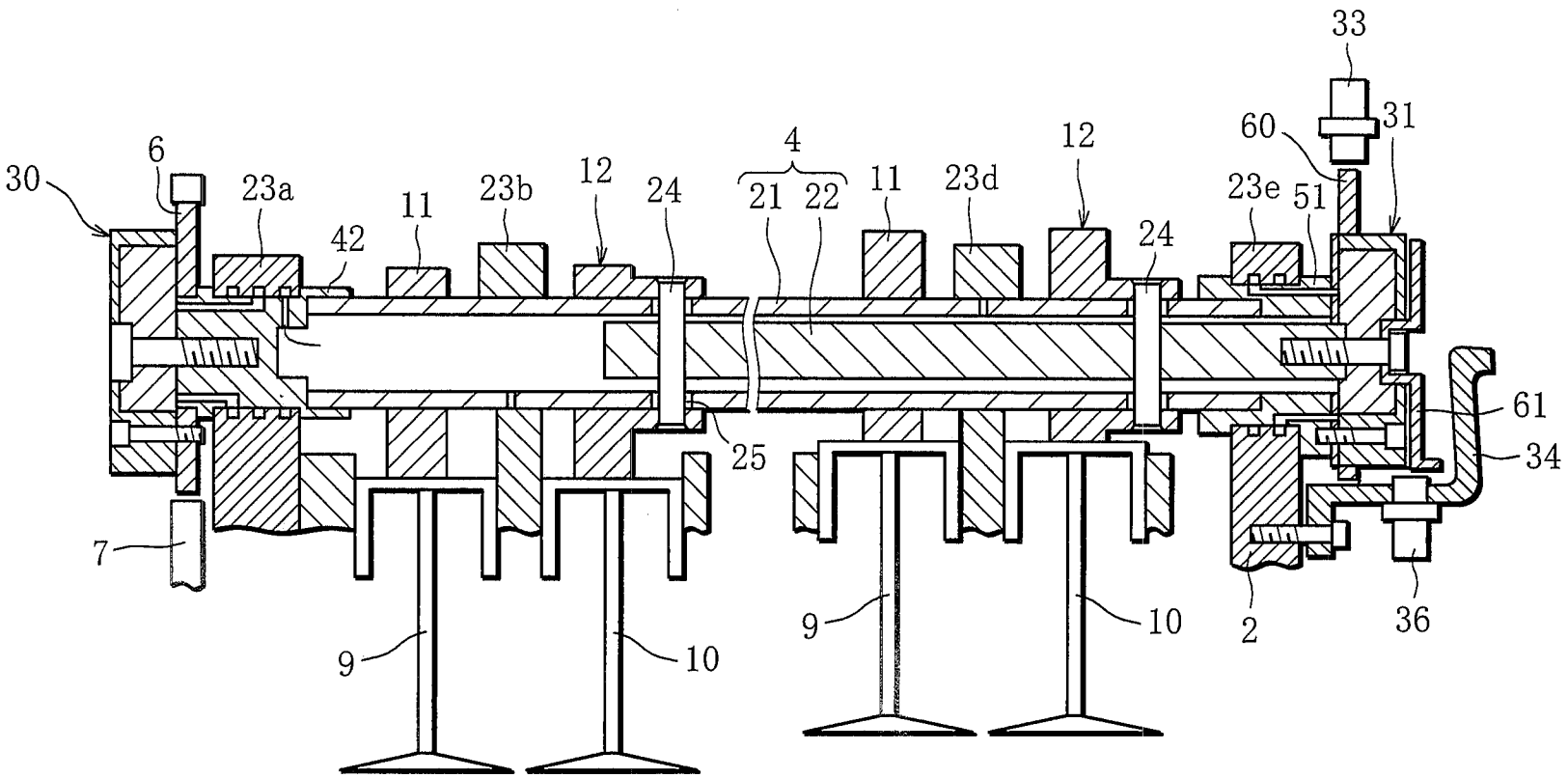
FIG. 3 is a longitudinal sectional view illustrating the structure of a valve device according to a second embodiment of the present invention.
Figure 4:
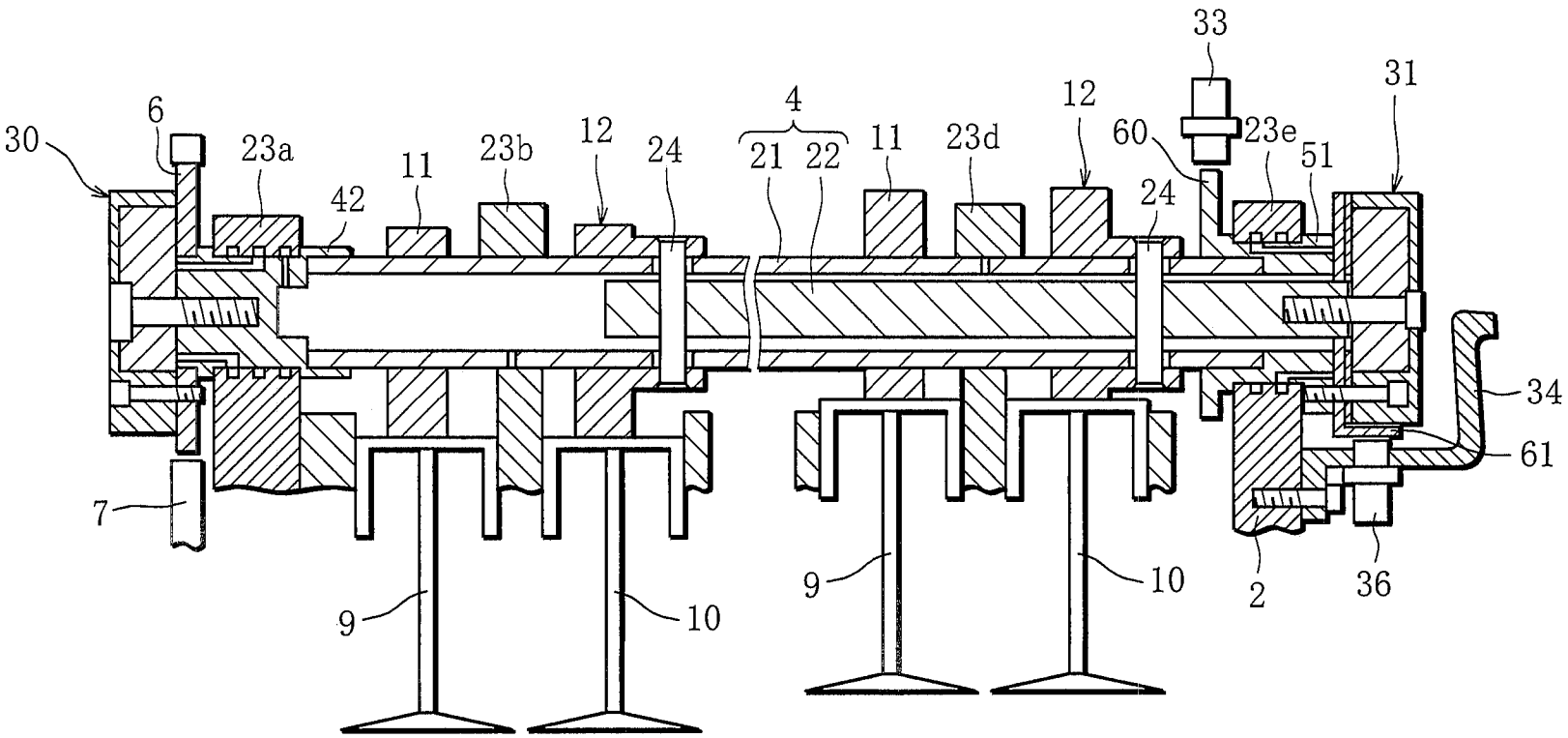
FIG. 4 is a longitudinal sectional view illustrating the structure of a valve device according to a third embodiment of the present invention.

Also, in the first embodiment described above, the sensor target 60 is attached to the outer camshaft 21 while the sensor target 61 is attached to the second cam phase change mechanism 31. Alternatively, the sensor target 60 may be attached to the second cam phase change mechanism 31 as shown in FIG. 3 (second embodiment), and the sensor target 61 may be attached to the inner camshaft 22 as shown in FIG. 4 (third embodiment).

Because of the torsional vibration of the camshaft, the detection values of the cam sensors are subject to fluctuation, but since the detection values are generally synchronized, it is not necessary to remove noise from the detection values insofar as the difference between the two detection values is used for the control of the phase difference. In cases where the detection values are subjected to noise removal before use, the possibility of the two detection values involving deviation can be lessened, permitting stable engine control.

In the foregoing embodiment, moreover, the present invention is applied to the DOHC three-cylinder engine. It is to noted, however, that the present invention is equally applicable to an SOHC engine as well as to an engine with a different number of cylinders.

What is claimed is:

1. An internal combustion engine with a variable valve device, comprising:

the engine including cylinders each provided with a plurality of intake valves, a first camshaft and a second camshaft arranged coaxially with each other, the first camshaft being configured to drive cams for actuating some of the valves among said plurality of intake valves and the second camshaft being configured to drive cams for actuating other of the valves among said plurality of intake valves, a cam phase change mechanism arranged at one end of the first and second camshafts and capable of varying a phase difference between the first and second camshafts, a first detection unit that detects a rotational angle of the first camshaft;

a second detection unit that detects a rotational angle of the second camshaft; and a cam sprocket arranged at an end of the first camshaft opposite the cam phase change mechanism, wherein the first and second detection units are arranged on an identical side of the engine with respect to an axial direction of the first and second camshafts, and the first and second detection units are arranged on a side opposite to the cam sprocket with respect to the axial direction of the first and second camshafts, wherein at least one of the first and second detection units detects the rotational angle of a rotating element constituting the cam phase change mechanism, and wherein operation of the cam phase change mechanism is controlled based on a phase difference between the first and second camshafts derived from detection results of the first and second detection units.

2. The internal combustion engine according to claim 1, wherein the first and second detection units are arranged on one side of the engine which is closer to the cam phase change mechanism with respect to the axial direction of the first and second camshafts.

3. The internal combustion engine according to claim 1, further comprising:

an additional cam phase change mechanism arranged at an opposite end of the first camshaft and capable of varying phases of the first and second camshafts.

4. The internal combustion engine according to claim 1, wherein the first detection unit includes a first sensor target that rotates with the first camshaft, and a first cam sensor provided in a proximity of the sensor target.

5. The internal combustion engine according to claim 4, wherein the first sensor target is attached to an outer periphery of the first camshaft.

6. The internal combustion engine according to claim 1, wherein the second detection unit includes a second sensor target that rotates with the second camshaft, and a second cam sensor provided in a proximity of the second sensor target.

7. The internal combustion engine according to claim 6, wherein the second sensor target is attached to an end of the second camshaft.

8. The internal combustion engine according to claim 1, wherein the first sensor target is arranged in a proximity of a supporting portion of the cam journal.

9. An internal combustion engine with a variable valve device, comprising:

the engine including cylinders each provided with a plurality of exhaust valves, a first camshaft and a second camshaft arranged coaxially with each other, the first camshaft being configured to drive cams for actuating some of the valves among said plurality of exhaust valves and the second camshaft being configured to drive cams for actuating other of the valves among said plurality of exhaust valves, a cam phase change mechanism arranged at one end of the first and second camshafts and capable of varying a phase difference between the first and second camshafts, a first detection unit that detects a rotational angle of the first camshaft; and a second detection unit that detects a rotational angle of the second camshaft, a cam sprocket arranged at an end of the first camshaft opposite the cam phase change mechanism, wherein the first and second detection units are arranged on an identical side of the engine with respect to an axial direction of the first and second camshafts, the first and second detection units are arranged on a side opposite to the cam sprocket with respect to the axial direction of the first and second camshafts, wherein at least one of the first and second detection units detects the rotational angle of a rotating element constituting the cam phase change mechanism, and wherein operation of the cam phase change mechanism is controlled based on a phase difference between the first and second camshafts derived from detection results of the first and second detection units.

10. The internal combustion engine according to claim 9, wherein the first and second detection units are arranged on one side of the engine which is closer to the cam phase change mechanism with respect to the axial direction of the first and second camshafts.

11. The internal combustion engine according to claim 9, further comprising:

an additional cam phase change mechanism arranged at an opposite end of the first camshaft and capable of varying phases of the first and second camshafts.

12. The internal combustion engine according to claim 9, wherein the first detection unit includes a first sensor target that rotates with the first camshaft, and a first cam sensor provided in a proximity of the sensor target.

13. The internal combustion engine according to claim 12, wherein the first sensor target is attached to an outer periphery of the first camshaft.

14. The internal combustion engine according to claim 9, wherein the second detection unit includes a second sensor target that rotates with the second camshaft, and a second cam sensor provided in a proximity of the second sensor target.

15. The internal combustion engine according to claim 14, wherein the second sensor target is attached to an end of the second camshaft.

16. The internal combustion engine according to claim 9, wherein the first sensor target is arranged in a proximity of a supporting portion of the cam journal.

* * * * *